US009605374B2

(12) United States Patent
Sar et al.

(10) Patent No.: US 9,605,374 B2
(45) Date of Patent: Mar. 28, 2017

(54) DRYER COMPRISING A DISMOUNTABLE MEMBER

(75) Inventors: Can Sar, Istanbul (TR); Atilla Sevli, Istanbul (TR); Veysel Ertan Cetinkaya, Istanbul (TR); Idris Burak Harac, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 879 days.

(21) Appl. No.: 13/977,717

(22) PCT Filed: Dec. 28, 2011

(86) PCT No.: PCT/EP2011/074165

§ 371 (c)(1),
(2), (4) Date: Dec. 23, 2013

(87) PCT Pub. No.: WO2012/089771

PCT Pub. Date: Jul. 5, 2012

(65) Prior Publication Data

US 2014/0096407 A1 Apr. 10, 2014

(30) Foreign Application Priority Data

Dec. 31, 2010 (TR) ..... a 2010 11268

(51) Int. Cl.

| | |
|---|---|
| ***D06F 58/20*** | (2006.01) |
| ***D06F 58/02*** | (2006.01) |
| ***D06F 39/12*** | (2006.01) |
| ***D06F 25/00*** | (2006.01) |
| ***D06F 58/26*** | (2006.01) |

(52) U.S. Cl.

CPC ..... *D06F 58/02* (2013.01); *D06F 25/00* (2013.01); *D06F 39/12* (2013.01); *D06F 58/26* (2013.01)

(58) Field of Classification Search

CPC ..... D06F 58/20; D06F 39/12; D06F 58/22; D06F 58/24; D06F 58/02; D06F 25/00; E05Y 2900/00; E05Y 2900/312; E05D 7/10

See application file for complete search history.

(56) References Cited

FOREIGN PATENT DOCUMENTS

| | | | | |
|---|---|---|---|---|
| GB | 1417833 A | * | 12/1975 | ..... D06F 58/22 |
| KR | EP 1273750 A2 | * | 1/2003 | ..... E05D 11/105 |

* cited by examiner

*Primary Examiner* — Jiping Lu

(74) *Attorney, Agent, or Firm* — Kilpatrick Townsend & Stockton LLP

(57) ABSTRACT

The present invention relates to a dryer (1) comprising a body (2), a drum (3) disposed inside the body (2), wherein the laundry to be dried is placed, an opening (4) which is situated on the body (2), a dismountable member (5) which is placed into the body (2) by being passed through the opening (4), whereon the particles in the air leaving the drum (3) are accumulated and a lid (6) which covers the opening (4) so as to close the front of the dismountable member (5).

18 Claims, 5 Drawing Sheets

DRYER COMPRISING A DISMOUNTABLE MEMBER

Figure 1:
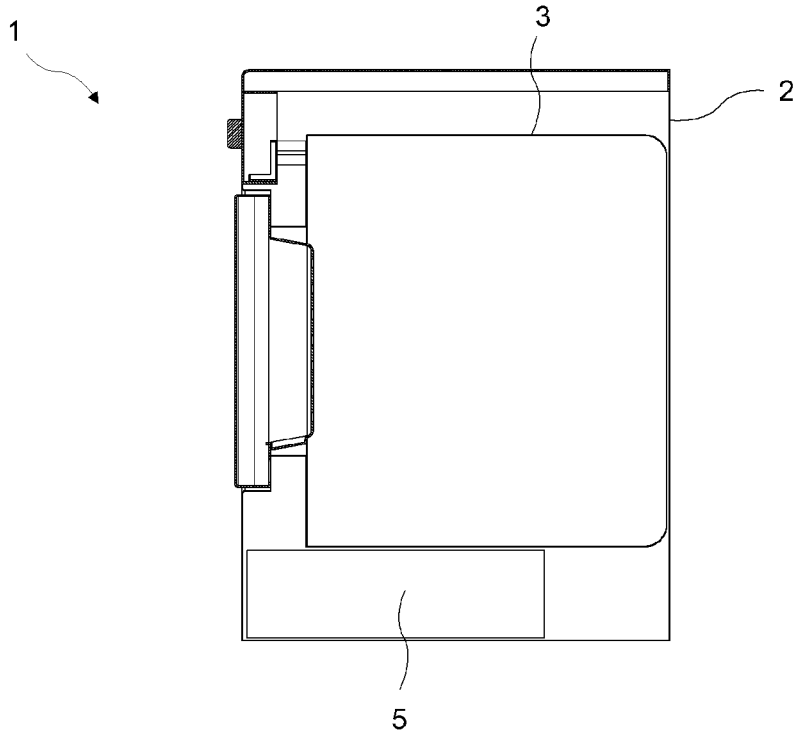

The present invention relates to a dryer comprising a dismountable member.

In state of the art dryers, the wet laundry placed into a rotating drum are provided to be dried by being contacted with hot air. The hot circulation air evaporates the moisture of the laundry that it passes over and sweeps it away from the laundry. While passing through a heat exchanger, preferably a condenser, the hot air enters into heat exchange with a fluid having a lower temperature, preferably air, and leaves there the moisture that condenses due to the temperature difference. The said heat exchange causes the circulation air to be cooled as well as to be dried by leaving its moisture. After passing through the condenser, the circulation air is heated by being passed through a heater disposed on a point further than the air channel and is sent again to the drum.

The condensers used in the dryers are configured such that the hot circulation air enters from one side and the fluid with a lower temperature, for example the cooling air, enters from the other side without mixing with the circulation air. While the hot circulation air removes the moisture of the laundry in the drum, the particles such as fiber and fluff formed in clothes due to usage also mix into the air together with the moisture. These particles cause the condenser to be clogged or cause the performance thereof to decrease in due course. Thus, the air leaving the drum is required to be passed through filters. The particles that leave the laundry and mix into the air are first held by the lid filter. The particles that cannot be held by the lid filter are held in the filter box behind the kick plate before reaching the condenser. The lid filter and the filters in the filter box are required to be periodically cleaned by the user by being dismounted.

In other state of the art embodiments, the condenser, together with the filter, is also mounted to its place in the dryer such that the user can place it into its place after dismounting and cleaning.

In these state of the art embodiments, an opening is situated on the dryer body for mounting and dismounting the condenser and the filter disposed before the condenser. The opening is closed by means of a lid at the same level with the body in order to prevent the entry of foreign matters into the dryer and provide visual integrity.

In the state of the art Chinese Patent Application No. CN1888271, a dryer is explained comprising a lid mounted to the body by means of the horizontal hookers disposed at the lower edge thereof and the vertical hookers disposed at the upper edge thereof.

In another state of the art embodiment, the Great Britain Patent Application No. GB1417833, a dryer is explained comprising a lid that is pivoted to the body so as to be opened by rotating such that one edge of the lid is the rotational axis.

The aim of the present invention is the realization of a dryer comprising a condenser and/or filter which can be easily mounted and dismounted.

In the dryer realized in order to attain the aim of the present invention and explicated in the first claim and the respective claims thereof, the opening, which is disposed on the body and which enables a dismountable member such as condenser, filter etc. to be placed into the body, is closed by means of a lid.

The lid is mounted to the body so as to open by rotating on one side of the opening. On the body, two housings are disposed, positioned at intervals on one side of the opening, providing the lid to be pivoted. The housings are preferably positioned at a point close to the corners of the side where they are mounted. On the lid, two pipe-shaped connecting members are disposed, corresponding to the housings. Each connecting member is mounted to the respective housing by inserting a shaft therethrough and thus the lid is provided to be mounted to the body. The end of the connecting member opposite to the housing is closed by means of a retainer, thus preventing the shaft from dislodging from the housing. Thus, the lid is provided to be practically mounted to the body. By mounting the lid to the body by using two short shafts instead of one full-length shaft, the lid is provided to be used more safely and for a longer time.

In an embodiment of the present invention, when the assembly is completed by mounting the shaft to the housing, and the retainer to the connecting member, the shaft remains entirely in the housing, the retainer and the connecting member. In other words, the length of the shaft is almost as much as the total of the channels that it is seated in the retainer, the housing and the connecting member. Thus, the shaft is provided to be effectively supported and is prevented from being seen from outside.

In an embodiment of the present invention, an extension extending perpendicularly to the shaft is disposed on the connecting member. The retainer is fixed to the connecting member by the detent means on the retainer being fastened on the extension. Consequently, the lid is provided to be easily mounted to and dismounted from the body.

In an embodiment of the present invention, the retainer and the shaft are provided to be easily mounted to the connecting member and the housing by inserting the slides on the sides of the retainer into the rails opened on the lid towards the housing.

In an embodiment of the present invention, the end of the shaft facing the retainer is embedded into the retainer. Thus, the retainer and the shaft are provided to move together and to be easily mounted and dismounted.

In a derivative of this embodiment, a cavity is opened on the surface facing the connecting member of the part of the shaft embedded into the retainer. When the shaft is placed into the connecting member, the connecting member is seated into the cavity. In other words, the shaft is inserted into the connecting member and the connecting member into the retainer, thus providing a stepped supporting.

In an embodiment of the present invention, when the shaft is seated into the housing, the protrusions on the retainer enter into the recesses on the extension, thus improving the assembly of the retainer onto the lid.

In an embodiment of the present invention, the housings are independent elements that are mounted to the flange of the body extending towards the opening. Thus, by providing the housing to be detachable, the maintenance efficiency of the dryer is increased.

In an embodiment of the present invention, the opening and the lid are disposed at the front lower portion of the body. The front wall which closes preferably the front surface of the body ends at a level a little higher than the floor and a space that allows the placement of the dismountable member is left between the front wall and the base. The width of the dismountable member is less than the half of the width of the body. The front of the portion where the dismountable member is placed is covered by the lid. The body furthermore comprises a panel that closes the space that remains near the lid.

In an embodiment of the present invention, the lid is opened by rotating around the vertical axis. In this embodiment, the lid is pivoted to the side of the opening close to the body side wall. Thus, the lid is provided to be easily opened with a wide angle.

In different embodiments of the present invention, the dryer is a heat pump or conventional type dryer. Accordingly, the dismountable member can be a filter, a condenser or a condenser group wherein the filter and the condenser are present together.

By means of the present invention, the lid is provided to be safely and durably pivoted to the body without requiring an additional fixing member.

A dryer realized in order to attain the aim of the present invention is illustrated in the attached figures, where:

FIG. 1—is the schematic view of a dryer.

Figure 2:
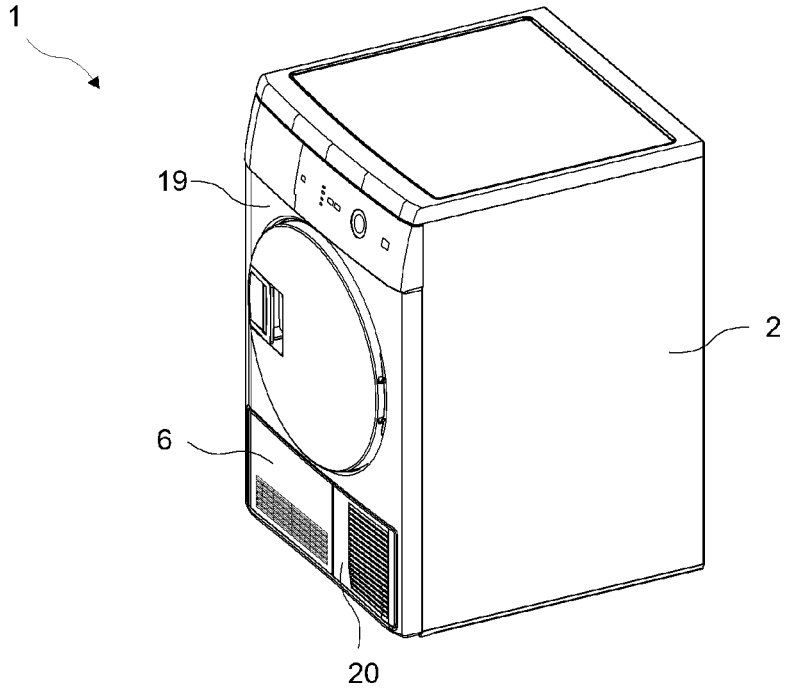

FIG. 2—is the perspective view of a dryer.

Figure 3:
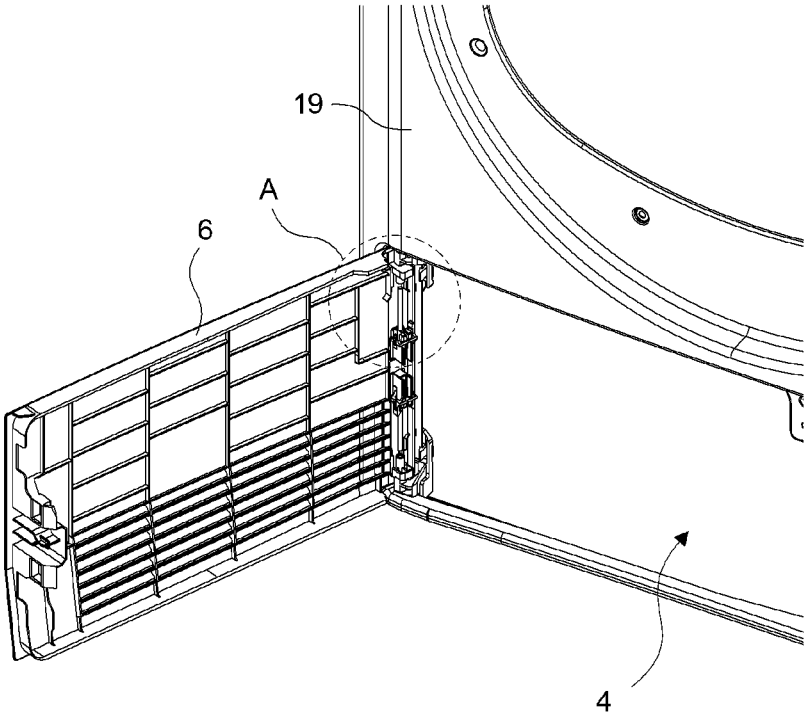

FIG. 3—is the partial view of a dryer when the lid is open, and the shaft and the retainer are not mounted.

Figure 4:
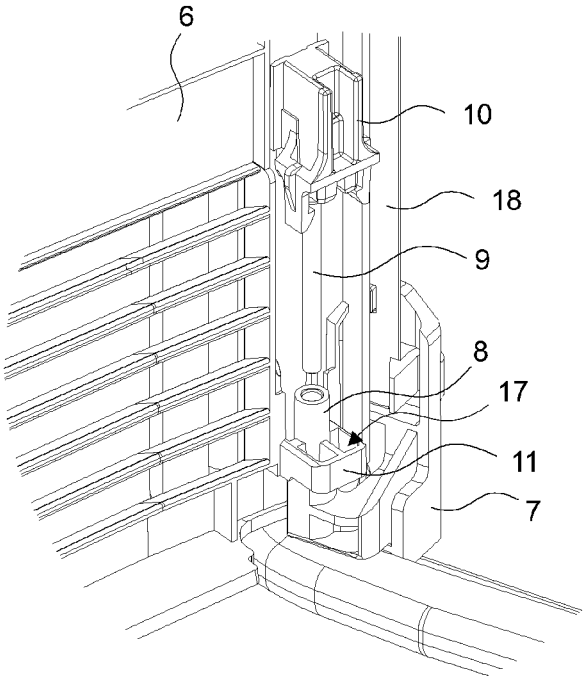

FIG. 4—is the view of detail A in FIG. 3.

Figure 5:
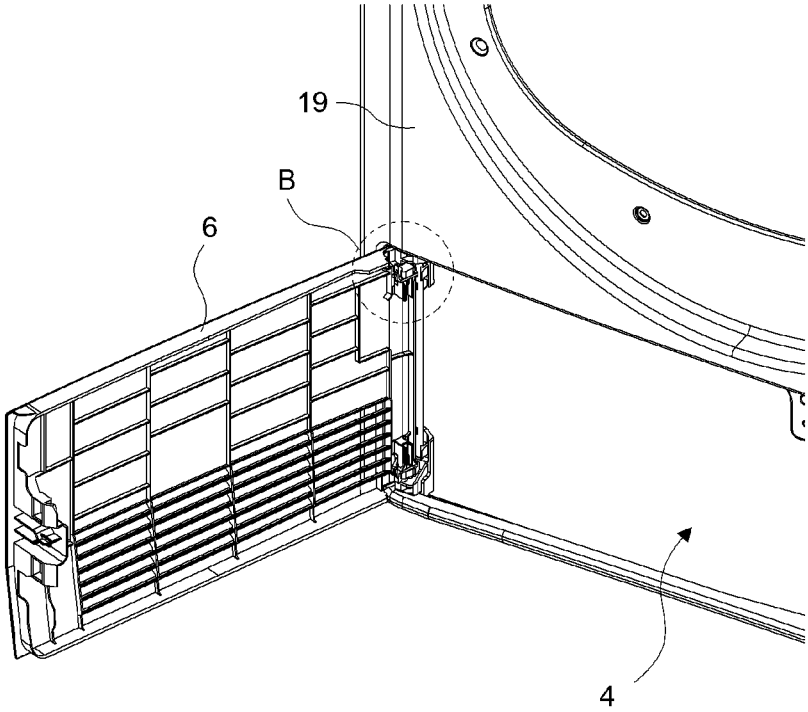

FIG. 5—is the partial view of a dryer when the lid is open.

Figure 6:
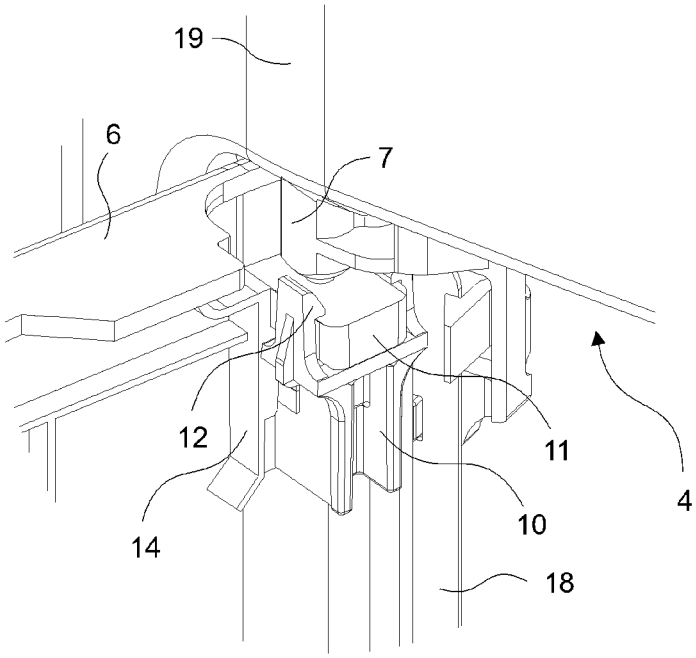

FIG. 6—is the view of detail B in FIG. 5.

Figure 7:
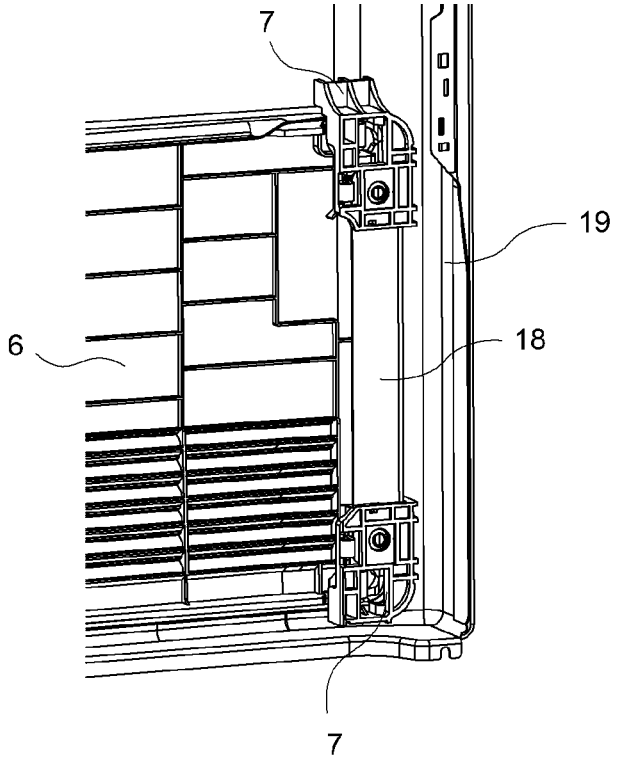

FIG. 7—is the inner view of the front wall, the lid and the housing.

Figure 8:
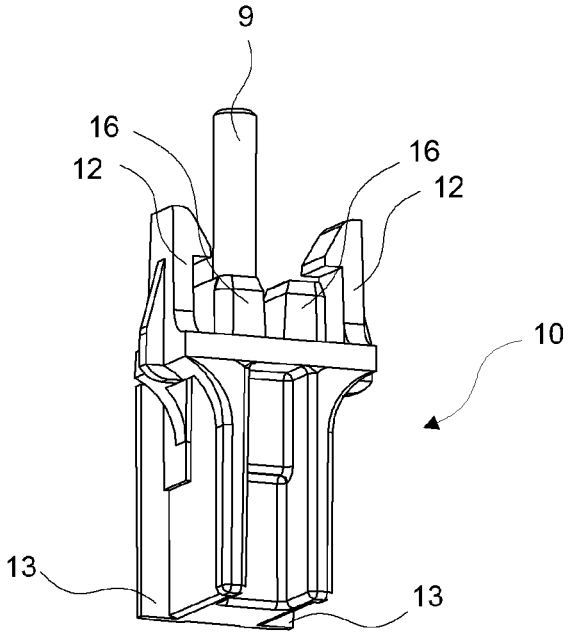

FIG. 8—is the perspective view of the retainer and the shaft.

Figure 9:
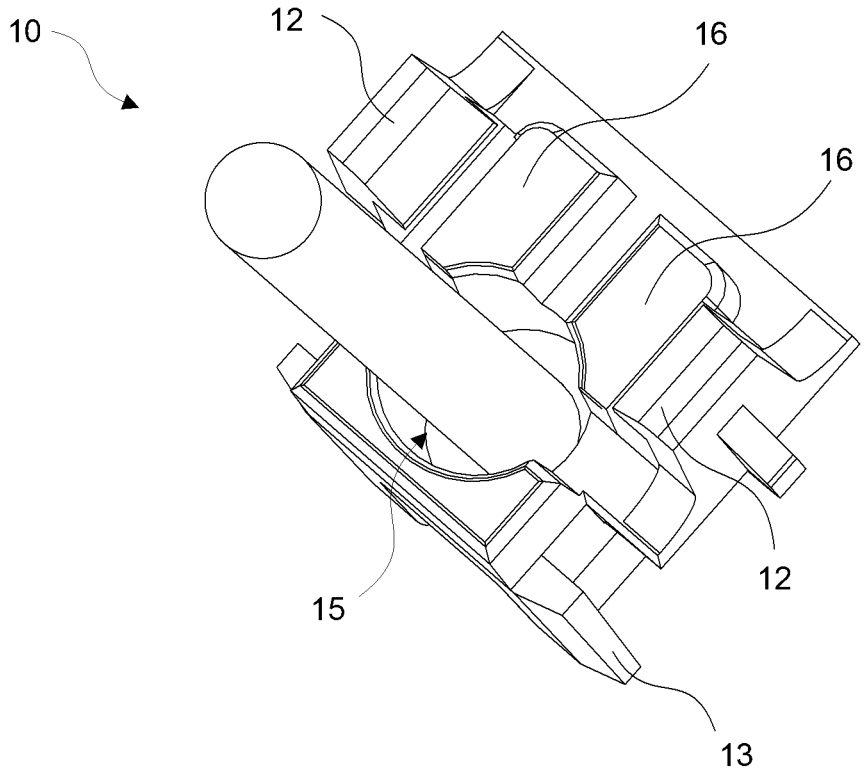

FIG. 9—is the perspective view of the retainer and the shaft from another angle.

The elements illustrated in the figures are numbered as follows:

1. Dryer
2. Body
3. Drum
4. Opening
5. Dismountable member
6. Lid
7. Housing
8. Connecting member
9. Shaft
10. Retainer
11. Extension
12. Detent means
13. Slide
14. Rail
15. Cavity
16. Protrusion
17. Recess
18. Flange
19. Front wall
20. Panel The dryer (1) of the present invention comprises a body (2), a drum (3) disposed inside the body (2), wherein the laundry to be dried is placed, an opening (4) which is situated on the body (2), a dismountable member (5) which is placed into the body (2) by being passed through the opening (4), whereon the particles in the air leaving the drum (3) are accumulated, a lid (6) which covers the opening (4) so as to close the front of the dismountable member (5), opening by rotating, (FIG. 1).

The dryer (1) of the present invention furthermore comprises two housings (7) oppositely disposed on the body (2), one side of the opening (4) such that a distance remains therebetween, two connecting members (8) disposed on the lid (6), shaped as a hollow cylinder, two shafts (9) passing through each connecting member (8) to be seated into the housing (7), providing the lid (6) to be rotatably borne into the housing (7) and two retainers (10) disposed at the ends of the shafts (9) facing each other, preventing the shaft (9) from leaving the housing (7) by locking on the connecting member (8). Thus, the lid (6) is provided to be easily and durably connected to the body (2).

In an embodiment of the present invention, almost entire shaft (9) remains in the housing (7), the connecting member (8) and the retainer (10). Thus, the shaft (9) is provided to be effectively supported and the expected life thereof to be increased.

In an embodiment of the present invention, the lid (6) comprises an extension (11) disposed on the connecting member (8), extending in a direction perpendicular to the rotational axis of the shaft (9). In this embodiment, the retainer (10) comprises at least two detent means (12) seated onto the extension (11) and providing the retainer (10) to lock on the connecting member (8). Accordingly, the lid (6) is provided to be easily and detachably fixed on the body (2).

In an embodiment of the present invention, the retainer (10) comprises two slides (13), each disposed on one of two opposite sides thereof parallel to the shaft (9). In this embodiment, the lid (6) comprises two rails (14) wherein the slides (13) are placed when the shaft (9) is passed through the connecting member (8) to be seated into the housing (7).

In an embodiment of the present invention, one end of the shaft (9) is embedded into the retainer (10). Thus, the retainer (10) is provided to be inseparably fixed to the shaft (9).

In a derivative of this embodiment, the retainer (10) comprises a cavity (15) disposed on the side thereof facing the connecting member (8), that surrounds a portion of the shaft (9) and wherein the connecting member (8) is seated when the shaft (9) is seated into the housing (7). Thus, the connecting member (8) and the retainer (10) surround the shaft (9) in two layers.

In an embodiment of the present invention, the retainer (10) comprises at least one protrusion (16) disposed on the surface thereof facing the extension (11). In this embodiment, the lid (6) comprises at least one recess (17) wherein the protrusion (16) on the extension (11) is seated. Consequently, the retainer (10) is provided to be more efficiently fixed to the connecting member (8).

In an embodiment of the present invention, the body (2) comprises a flange (18) that is disposed on the side of the opening (4) to which the lid (6) is mounted and that extends towards the opening (4) and two housings (7) mounted onto the flange (18).

In an embodiment of the present invention, the opening (4) and hence the lid (6) are disposed at the front lower side of the body (2), at the region of the kick plate, close to its base.

In a derivative of this embodiment, the body (2) comprises a front wall (19) which covers the front surface of the body (2) to the level of the lid (6) and a panel (20) which covers the portion that remains below the front wall (19), near the lid (6).

In an embodiment of the present invention, the lid (6) opens by rotating around the vertical axis and is mounted to the side of the opening (4) close to the side wall of the body (2). Thus, since the opening angle of the lid (6) is limited by the body (2), the lid (6) does not form any obstruct during mounting and dismounting of the dismountable member (5).

In an embodiment of the present invention, the dryer (1) is of the heat pump type and the dismountable member (5) is a filter.

In another embodiment of the present invention, the dryer (1) is of conventional type and the dismountable member (5) is a condenser.

In yet another embodiment of the present invention, the dryer (1) is of conventional type and the dismountable member (5) is a condenser group that contains a condenser and filter.

By means of the present invention, a dryer (1) is realized wherein the lid (6) providing access to the dismountable member (5) for the user to realize the cleaning is connected to the body (2) by means of two short shafts (9) in a durable and easily detachable manner.

It is to be understood that the present invention is not limited to the embodiments disclosed above and a person skilled in the art can easily introduce different embodiments. These should be considered within the scope of the protection postulated by the claims of the present invention.

The invention claimed is:

1. A dryer (1) comprising a body (2), a drum (3) disposed inside the body (2), wherein the laundry to be dried is placed, an opening (4) which is situated on the body (2), a dismountable member (5) which is placed into the body (2) by being passed through the opening (4), whereon the particles in the air leaving the drum (3) are accumulated, a lid (6) which covers the opening (4) so as to close the front of the dismountable member (5), opening by rotating, characterized by two housings (7) oppositely disposed on one side of the opening (4) on the body (2) such that a distance remains therebetween, two connecting members (8) located on the lid (6), each disposed almost at the same level with the housing (7), shaped as a hollow cylinder, two shafts (9) passing through each connecting member (8) to be seated into the housing (7), providing the lid (6) to be rotatably borne into the housing (7) and two retainers (10) disposed at the ends of the shafts (9) facing each other, preventing the shaft (9) from leaving the housing (7) by locking on the connecting member (8), wherein the lid (6) comprises an extension (11) disposed on the connecting member (8), extending in a direction perpendicular to the rotational axis of the shaft (9) and the retainer (10) comprising at least two detent means (12) seated onto the extension (11) and providing the retainer (10) to be locked onto the connecting member (8).

2. The dryer (1) as in claim 1, wherein the shaft (9), almost all of which remains in the housing (7), the connecting member (8) and the retainer (10).

3. The dryer (1) as in claim 2, wherein the retainer (10) comprising two slides (13), each disposed on one of two opposite sides thereof parallel to the shaft (9) and the lid (6) comprising two rails (14) wherein the slides (13) are placed when the shaft (9) is passed through the connecting member (8) to be seated into the housing (7).

4. The dryer (1) as in claim 3, wherein the shaft (9), one end of which is embedded into the retainer (10).

5. The dryer (1) as in claim 4, wherein the retainer (10) comprising a cavity (15) disposed on the side thereof facing the connecting member (8), that surrounds a portion of the end of the shaft (9) in the retainer (10) and wherein the connecting member (8) is seated when the shaft (9) is seated into the housing (7).

6. The dryer (1) as in claim 5, wherein the retainer (10) comprising at least one protrusion (16) disposed on the surface thereof facing the extension (11) and the lid (6) comprising at least one recess (17) wherein the protrusion (16) on the extension (11) is seated.

7. The dryer (1) as in claim 6, further comprising a flange (18) that is disposed on the side of the opening (4) to which the lid (6) is mounted and that extends towards the opening (4), and two housings (7) mounted onto the flange (18).

8. The dryer (1) as in claim 7, wherein the opening (4) and the lid (6) disposed at the front lower side of the body (2), at the region of the kick plate, close to its base.

9. The dryer (1) as in claim 8, wherein the body (2) comprising a front wall (19) which covers the front surface of the body (2) to the level of the lid (6) and a panel (20) which covers the portion that remains below the front wall (19), near the lid (6).

10. The dryer (1) as in claim 1, wherein the dryer is a heat pump type dryer and the dismountable member (5) is a filter.

11. The dryer (1) as in claim 1, wherein the dryer is a convention type dryer and the dismountable member (5) is a condenser.

12. The dryer (1) as in claim 1, wherein the dryer is a convention type dryer and the dismountable member (5) is a condenser group that contains the condenser and the filter.

13. The dryer (1) as in claim 1, wherein the retainer (10) comprising two slides (13), each disposed on one of two opposite sides thereof parallel to the shaft (9) and the lid (6) comprising two rails (14) wherein the slides (13) are placed when the shaft (9) is passed through the connecting member (8) to be seated into the housing (7).

14. The dryer (1) as in claim 13, wherein the retainer (10) comprising at least one protrusion (16) disposed on the surface thereof facing an extension (11) and the lid (6) comprising at least one recess (17) wherein the protrusion (16) on the extension (11) is seated.

15. The dryer (1) as in claim 1, wherein the shaft (9), one end of which is embedded into the retainer (10).

16. The dryer (1) as in claim 1, further comprising a flange (18) that is disposed on the side of the opening (4) to which the lid (6) is mounted and that extends towards the opening (4), and two housings (7) mounted onto the flange (18).

17. The dryer (1) as in claim 1, wherein the opening (4) and the lid (6) disposed at the front lower side of the body (2), at the region of the kick plate, close to its base.

18. The dryer (1) as in claim 1, wherein the body (2) comprising a front wall (19) which covers the front surface of the body (2) to the level of the lid (6) and a panel (20) which covers the portion that remains below the front wall (19), near the lid (6).

* * * * *